US005160195A

United States Patent [19]

Miller

[11] Patent Number: 5,160,195

[45] Date of Patent: Nov. 3, 1992

[54] DISPLAY PANEL BACKLIGHTING SYSTEM

[75] Inventor: Eric A. Miller, Allston, Mass.

[73] Assignee: TigerMark, Allston, Mass.

[21] Appl. No.: 828,741

[22] Filed: Jan. 31, 1992

[51] Int. Cl.[5] ..... F21V 7/00

[52] U.S. Cl. ..... 362/300; 362/223; 362/297; 362/427

[58] Field of Search ..... 362/222, 223, 300, 297, 362/427

[56] References Cited

U.S. PATENT DOCUMENTS 4,335,421 6/1982 Modia et al. ..... 362/223

4,404,619 7/1983 Ferguson ..... 362/223

*Primary Examiner*—Carroll B. Dority

*Attorney, Agent, or Firm*—Lahive & Cockfield

[57] ABSTRACT

A display panel system includes a peripheral frame surrounding a translucent panel and an apparatus for backlighting the translucent panel. The backlighting apparatus includes a support arm hingedly connected to a light source. The support arm includes a gripping member, for securing the support arm to the peripheral frame for positioning the light source to radiate light through the translucent panel. In some embodiments, the backlighting apparatus further includes a reflector for reflecting stray light toward the translucent panel. The support arm is foldable against the light source to facilitate packing and shipping of the backlighting apparatus.

13 Claims, 3 Drawing Sheets

DISPLAY PANEL BACKLIGHTING SYSTEM

BACKGROUND OF THE INVENTION

The invention relates generally to the field of display panel systems. In particular, the invention concerns an apparatus for backlighting such a system.

Display panel systems, such as foldable display panel systems, serve an important marketing function at trade shows, retail installations, and other commercial venues. It has been estimated that at a trade show, a graphic display has less than five seconds to attract the attention of a potential customer. In this short time period, a message or image must be projected to make the customer want to acquire more information about the displayed product or service.

Studies have shown that backlighted images are up to three times more likely to be noticed than are reflectively lighted images. Indeed, various retailers have documented five to six times higher sales with the use of backlighted displays.

Backlighting systems currently available for use with display panel systems are heavy and bulky. Consequently, they consume large volumes of shipping space. This is critical in the case of travelling exhibitions which must constantly be set up, broken down, shipped to a new location, and set up again.

For example, one known system for backlighting a display panel includes a light box constructed of a plastic shell with a fluorescent light fixture attached to it. The shell is approximately four inches deep. When the fixture is completely assembled, it weighs approximately thirteen pounds.

Standard shipping cases for display panel systems are twelve inches by twenty-eight inches by forty inches. Known light boxes are packed back to back or opening to opening so that three light boxes require a twelve inch deep space. Accordingly, only three light boxes at a time can be shipped in standard shipping cases.

Another problem with known backlighting systems is "hot spots." Hot spots are bright spots which develop on backlighted graphic display panels because the backlighting source is positioned too closely to the back of the panel. When viewed from the front, these hot spots can distract a viewer from the image the display is designed to convey.

An object of the invention, therefore, is to provide a backlighting system for a display panel system which is easy to assemble and install. Another object of the invention is to Provide such a system that occupies less shipping space than known systems. Still another object is to provide such a system that eliminates the problems of hot spots such as are associated with known backlighting systems. Yet another object is to provide a backlighting system that has a very finished look from the back of a display panel system.

SUMMARY OF THE INVENTION

These and other objects are achieved by the present invention which in one aspect features an improvement in a display panel system. The display panel system includes a peripheral frame which surrounds a translucent display panel. The improvement comprises a backlighting system including a light source and a support arm which is hingedly connected to the light source. The support arm includes securing means for securing the support arm to the peripheral frame. When the support arm is secured to the peripheral frame, the light source is disposed at a distance from the back surface of the translucent panel for radiating light through the panel to evenly illuminate the front surface of the panel.

It is a significant feature of the invention that the support arm is hingedly connected to the light source. Accordingly, the support arm can be folded against the light source to provide a very compact structure for packing the system for storage or shipping.

A generally preferred, but optional feature of the inventive backlighting system is a reflector for reflecting light from the light source toward the translucent panel. This feature of the invention further serves to eliminate hot spots as viewed from the front of the panel. It also encloses light radiated by the light source and thereby provides the rear of the display panel system with a finished look.

A suitable reflector comprises at least two planar reflective elements hingedly connected to one another and connecting means for connecting to the peripheral frame. The reflective elements can be opened, in a tent-like configuration, and positioned on the rear of the display panel system. When not in use, the reflective elements can be folded together whereby they provide an extremely narrow profile for ease of packing and shipping.

In a particularly advantageous embodiment of this aspect of the invention, the reflector further includes two foldable end members attached to the planar reflective elements. The end members, typically trapezoid-shaped, prevent the reflective elements from opening too widely, and further enclose stray light to provide the back of the display panel system with an even more finished appearance.

These and other features of the invention will be more fully appreciated by reference to the following detailed description which is to be read in conjunction with the attached drawing.

DETAILED DESCRIPTION

As stated above, in one aspect the invention features an improvement in a display panel system which includes a peripheral frame surrounding a translucent panel. The improvement features a backlighting apparatus for illuminating the front surface of the display panel from the rear.

Figure 1:
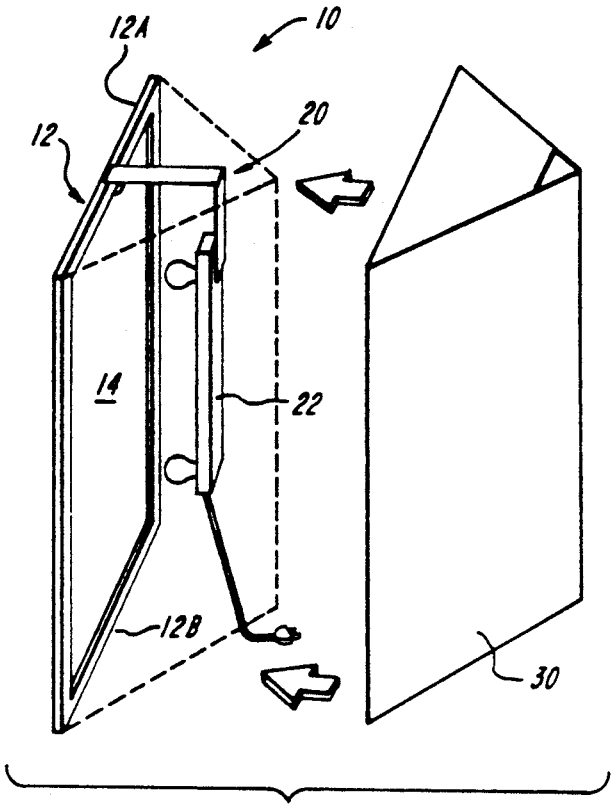
FIG. 1 is a perspective view of a panel display system utilizing a backlighting apparatus constructed in accordance with the teaching of the present invention.

FIG. 1 shows a typical display panel system 10 including a peripheral frame 12 and a translucent panel 14. In accordance with the teachings of the invention, the display system 10 further includes the improvement of a backlighting apparatus 20.

Figure 2A:
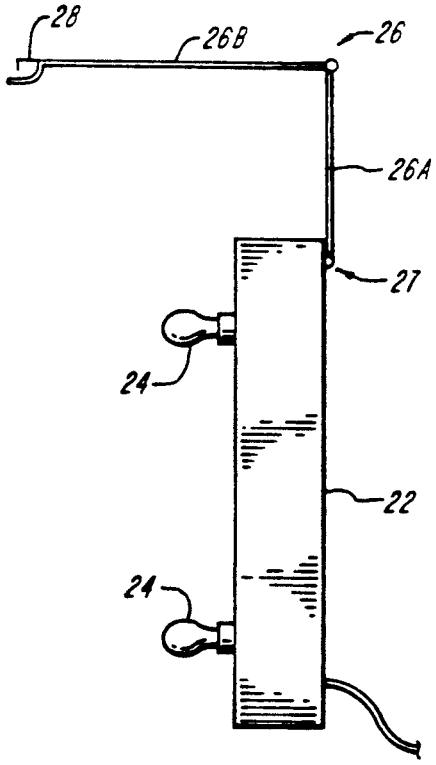
FIGS. 2A and 2B are side views of a light strip and support arm suitable for use with the backlighting system shown in FIG. 1.
Figure 2B:
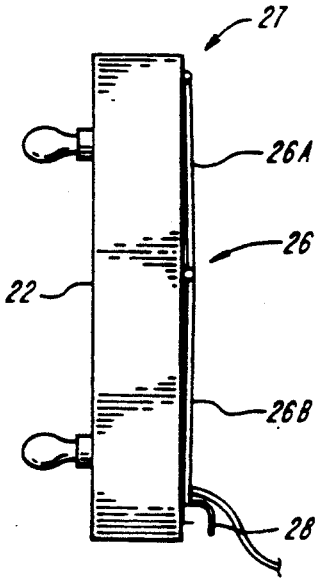

As shown in FIGS. 2A and 2B, the illustrated backlighting apparatus 20 includes a light strip 22 to which two light sources 24 are connected. While the illustrated light strip 22 includes two light sources 24, it should be understood that various numbers of light sources can be used depending on the desired effect. Moreover, various types of light sources such as incandescent, fluorescent, tungsten/halogen, and other generally known light sources can be used as well.

A support arm 26 is hingedly connected as at 27 to the light strip 22. A gripping member 28 is connected to the support arm 26 at an end distal to the hinged connection 27. As discussed below in greater detail, the gripping member 28 is suited for gripping both top peripheral frame member 12A individually, as well as two peripheral frame members arranged back to back such as when two display panels are stacked one on top of the other.

While in the illustrated embodiment the support arm 26 includes two hingedly connected support members 26A and 26B, it should be understood that the support arm 26 can also comprise a single rigid element. Additionally, while the illustrated support arm 26 is connected to the back of the light strip 22 via hinged connection 27, it is equally suitable to connect the support arm 26 to the top or side of the light strip 22. These variations will be readily recognized by those skilled in the art of mechanical linkages.

A significant feature of the invention is that by way of hinged connection 27, the support arm 26 can be pivoted with respect to light strip 22. As shown in FIG. 2A, support arm 26 can be arranged for connecting to a peripheral frame and disposing the light strip 22 behind a translucent panel 14. Additionally, as shown in FIG. 2B, support arm 26 can be folded against the back of light strip 22. When in the FIG. 2B configuration, the support arm 26 and light strip 22 provide a very compact structure that can be packed many to a box and easily shipped.

Figure 3:
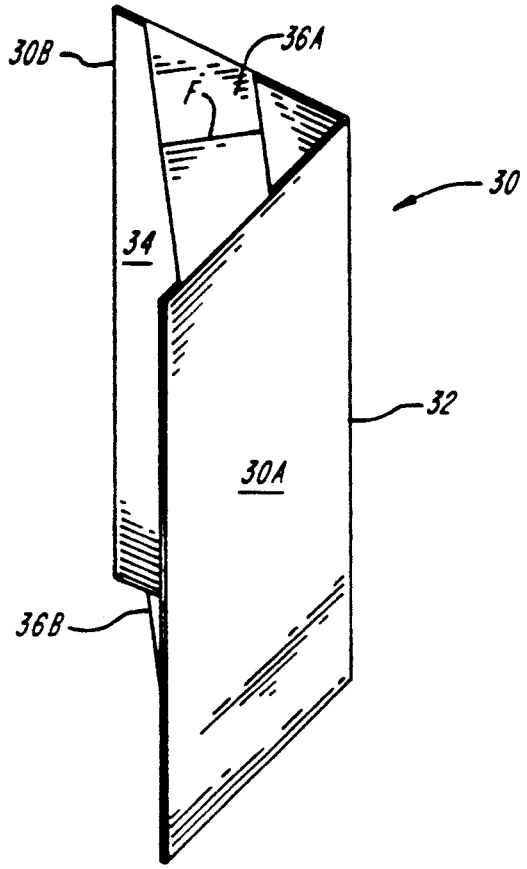
FIG. 3 is a perspective view of a reflector suitable for use with the backlighting system shown in FIG. 1.

As shown in FIG. 1, generally, and in FIG. 3 particularly, a preferred but optional feature of the backlighting apparatus of the invention is a reflector 30. The reflector 30 includes two planar reflective elements 30A and 30B. The reflective elements 30A and 30B are connected to one another along a hinged edge 32. Accordingly, the reflector 30 can be opened in a tent-like configuration as shown in the Figures, or folded together to facilitate packing and shipping.

The planar reflector elements 30A and 30B have highly reflective surfaces 34 for reflecting light generated by the light source 24 toward the translucent panel 14. Various reflective finishes such as metallized, bright white, or other finishes are suitable for this purpose. In embodiments of the invention including the reflector 30, therefore, the disposition of the light source 24 a distance from the translucent panel 14 operates in combination with the reflector 30 to greatly diminish the above discussed problems associated with hot spots such as are experienced in conjunction with known backlighting system. The reflector 30 can be attached to the peripheral frame by various known mechanisms such as by snaps, pins, or a VELCRO TM type hook and loop fastening system.

In some embodiments, the reflector further includes foldable end members 36A and 36B. The end members 36A and 36B prevent the planar reflective members 30A and 30B from being opened too far, and enclose stray light radiated by the light source to provide the rear of the display panel system with a generally more finished look. Additionally, the end members 36A and 36B enhance the reflector's reflective ability thereby further serving to eliminate problems associated with hot spots. The end members 36A and 36B are foldable along axis F to enable the planar elements 30A and 30B to be folded together for ease of packing and shipping.

Figure 4:
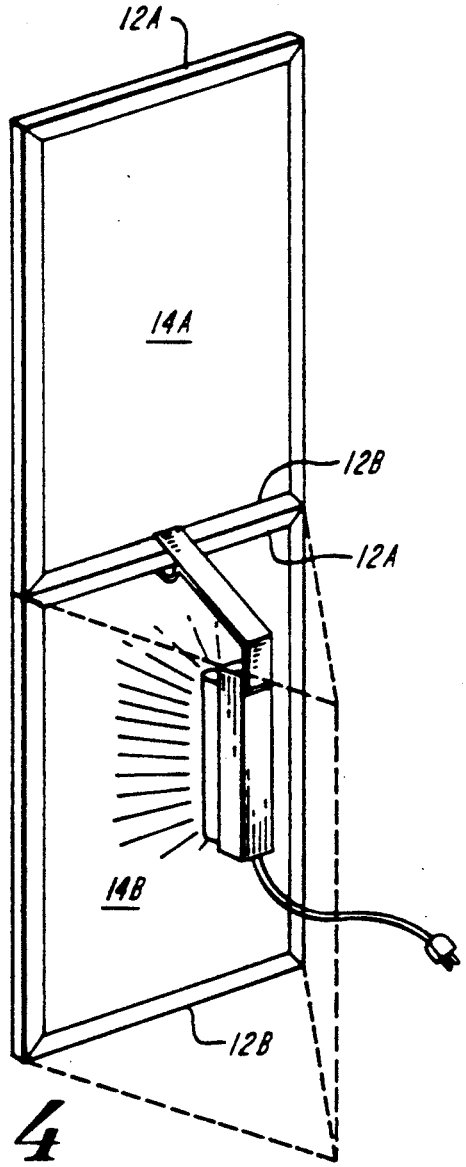
FIG. 4 is a perspective view of another graphic panel display system utilizing a backlighting apparatus of the invention.

Another significant feature of the invention is the gripping member's ability to secure the support arm 26 to both the upper peripheral frame member 12A individually, as well as to two peripheral frame members arranged back to back such as when, as shown in FIG. 4, two display panels are stacked one on top of the other. In such systems, the gripping member 28 enables the light strip 22 to be positioned for backlighting either of panels 14A or 14B. Also, multiple backlighting apparatus can be used for backlighting both panels 14A and 14B.

Figure 5:
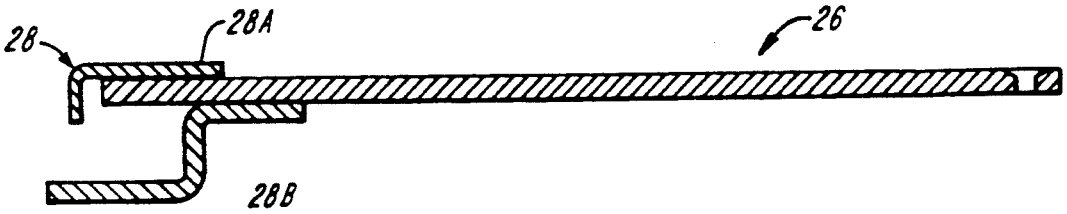
FIG. 5 is a plan view of a support arm suitable for use with the backlighting system shown in FIG. 4.
Figure 6A:
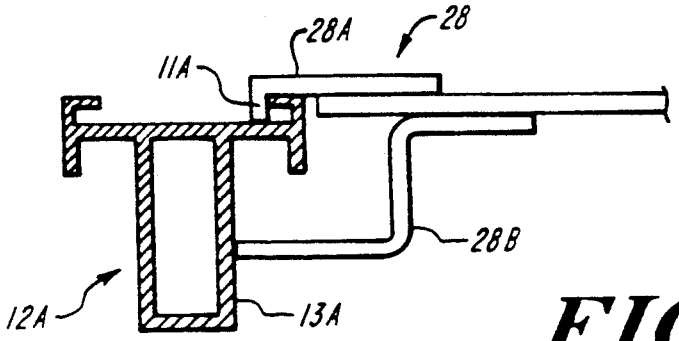
FIGS. 6A and 6B are partial cross-section views of two arrangements of the support arm shown in FIG. 1.
Figure 6B:
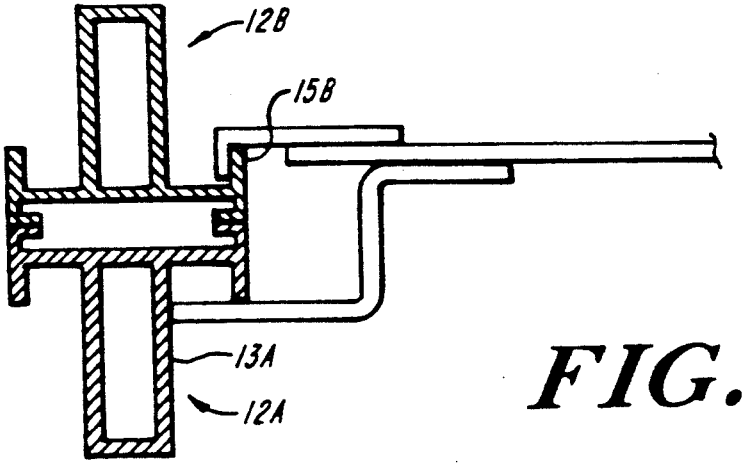

As shown more clearly in FIG. 5, the gripping member 28 includes an upper bracket 28A and a lower bracket 28B. The brackets 28A and 28B are connected to the support arm 26 in a manner generally known in the art. When secured to the upper frame member 12A (FIG. 6A), the upper bracket 28A hooks onto an upper flange 11A. The lower bracket 28B supports the arm 26 against brace 13A forming part of the upper peripheral frame member 12A. When secured to two peripheral frame members 12B and 12A as shown in FIG. 6B, however, the upper bracket 28A hooks against a flange 15B of lower frame member 12B. In this configuration, the lower bracket 28B supports the arm 26 against brace 13A of peripheral frame member 12A which forms part of the peripheral frame border around translucent panel 14B.

It can be seen, therefore, that the invention provides a versatile, convenient apparatus for backlighting translucent panels in a panel display system. Moreover, the inventive backlighting apparatus is collapsible so that when not in use, it presents a very compact structure to facilitate packing and shipping.

While various embodiments of the invention have been described in detail, various alterations to those embodiments, which will be apparent to those skilled in the art, are intended to be embraced within the spirit and scope of the invention. The invention is to be defined therefore, not by the preceding detailed description but by the claims that follow.

What is claimed is:

1. In a display system including a peripheral frame surrounding a translucent panel having front and back surfaces, the improvement comprising an apparatus for lighting the panel from the back surface comprising, a light source, a support arm hingedly connected to the light source, and including securing means for releasably securing the support arm to the peripheral frame, the support arm being arranged in relation to the light source so that the light source is disposed at a distance from the back surface of the panel for radiating light through the panel to evenly illuminate the front surface when the support arm is secured to the peripheral frame, and the support arm being foldable against the light source to provide a compact structure for storage and transportation when the backlighting apparatus is not in use.

2. Display panel system as set forth in claim 1 wherein the improvement further comprises a reflector, including connecting means for connecting to the peripheral frame, arranged for reflecting light radiated by the light source toward the panel when connected to the peripheral frame.

3. Display panel system as set forth in claim 2 wherein the reflector comprises two planar reflective elements hingedly connected to one another along a first edge.

4. Display panel system as set forth in claim 3 wherein the reflector further comprises a foldable end member attached to an edge of each planar reflective element which is adjacent to the first edge.

5. Display panel system as set forth in claim 4 wherein the reflector further comprises a second foldable end member attached to another edge of each planar reflective element which is adjacent to the first edge.

6. Display panel system as set forth in claim 1 further comprising a second peripheral frame, and wherein the securing means is shaped for securing the support arm to the first peripheral frame individually of collectively to said first and second peripheral frames.

7. Display panel system comprising a translucent panel having front and back surfaces, a peripheral frame surrounding the translucent panel, and an apparatus for lighting the panel from the back surface comprising, a light source, a support arm hingedly connected to the light source, and including securing means for releasably securing the support arm to the peripheral frame the support arm being arranged in relation to the light source so that the light source is disposed at a distance from the back surface of the panel for radiating light through the Panel to evenly illuminate the front surface when the support arm is secured to the peripheral frame, and the support arm being foldable against the light source to provide a compact structure for storage and transportation when the backlighting apparatus is not in use.

8. Display panel system as set forth in claim 7 further comprising a reflector, including connecting means for connecting to the peripheral frame, arranged for reflecting light radiated by the light source toward the panel when connected to the peripheral frame.

9. Display panel system as set forth in claim 8 wherein the reflector comprises two, planar reflective elements hingedly connected to one another along a first edge.

10. Display panel system as set forth in claim 9 wherein the reflector further comprises a foldable end member attached to an edge of each planar reflective element which is adjacent to the first edge.

11. Display panel system as set forth in claim 10 wherein the reflector further comprises a second foldable end member attached to another edge of each planar reflective element which is adjacent to the first edge.

12. Display panel system as set forth in claim 7 further comprising a second peripheral frame, and wherein the securing means is shaped for securing the support arm to the first peripheral frame individually or collectively to the first and second peripheral frames.

13. Display panel system as set forth in claim 12 wherein the first frame is stacked above the second panel.

* * * * *